US010876390B1

(12) United States Patent
Scotvold et al.

(10) Patent No.: US 10,876,390 B1
(45) Date of Patent: Dec. 29, 2020

(54) METHOD OF CONTROLLING A DRILLING OPERATION, AND ROTATING CONTROL DEVICE MITIGATOR

(71) Applicant: Pason Systems Corp., Calgary (CA)

(72) Inventors: Sean William Scotvold, Calgary (CA); Choon-Sun James Ng, Calgary (CA); Quinn Harrison Hepburn, Calgary (CA); John Aaron Eddy, Calgary (CA)

(73) Assignee: Pason Systems Corp., Calgary (CA)

( * ) Notice: Subject to any disclaimer, the term of this patent is extended or adjusted under 35 U.S.C. 154(b) by 0 days.

(21) Appl. No.: 16/867,858

(22) Filed: May 6, 2020

(30) Foreign Application Priority Data

Apr. 9, 2020 (CA) ..... CA3077714

(51) Int. Cl.
*E21B 44/02* (2006.01)
*E21B 47/09* (2012.01)
*E21B 33/08* (2006.01)

(52) U.S. Cl.
CPC ..... *E21B 44/02* (2013.01); *E21B 33/085* (2013.01); *E21B 47/09* (2013.01)

(58) Field of Classification Search
CPC . E21B 19/16; E21B 3/02; E21B 44/00; E21B 44/02; E21B 33/085
See application file for complete search history.

(56) References Cited

U.S. PATENT DOCUMENTS

| | | | | |
|---|---|---|---|---|
| 8,490,719 | B2 | 7/2013 | Duhe | |
| 9,637,995 | B2 * | 5/2017 | Ayling | E21B 19/161 |
| 10,185,306 | B2 | 1/2019 | Pradeepkumar | |
| 2012/0125686 | A1 * | 5/2012 | Hogseth | E21B 47/12 175/40 |
| 2014/0124267 | A1 * | 5/2014 | Ayling | E21B 21/01 175/40 |
| 2016/0273333 | A1 * | 9/2016 | Pool | E21B 33/085 |
| 2018/0245444 | A1 | 8/2018 | Hardt | |
| 2019/0390525 | A1 | 12/2019 | Keith | |

* cited by examiner

*Primary Examiner* — Kipp C Wallace
(74) *Attorney, Agent, or Firm* — D'Ambrosio & Menon, PLLC; Usha Menon

(57) ABSTRACT

There is described a method of controlling a drilling operation. A pipe joint is determined to be entering a rotating control device (RCD). In response to determining that the pipe joint is entering the RCD, a weight-on-bit (WOB) setpoint is increased so as to increase a measured WOB. After increasing the WOB setpoint, the pipe joint is determined to be exiting the RCD. In response to determining that the pipe joint is exiting the RCD, the WOB setpoint is decreased so as to decrease the measured WOB.

25 Claims, 10 Drawing Sheets

No RCD Mitigation

Un-ramped RCD Mitigation

Ramped RCD Mitigation

METHOD OF CONTROLLING A DRILLING OPERATION, AND ROTATING CONTROL DEVICE MITIGATOR

CROSS-REFERENCE TO RELATED APPLICATIONS

This application is related to and claims priority to Canadian Patent Application No.: 3077714 filed on Apr. 9, 2020, the contents of which are incorporated by reference herein.

FIELD OF THE DISCLOSURE

The present disclosure relates to methods of controlling a drilling operation, and to a rotating control device mitigator for controlling a drilling operation.

BACKGROUND TO THE DISCLOSURE

During oil and gas drilling, a Rotating Control Device (RCD) is a device situated above the blowout preventer that forms a seal around the drill string. The RCD is designed to maintain pressure within the wellbore and prevent wellbore fluids from being released from the wellbore around the drill string. Drilling with an RCD is required for, but not limited to, Managed Pressure Drilling.

The axial motion of the drill string is typically controlled by an automatic driller connected to a drawworks system, and the drill string's rotational motion is typically controlled by a top drive. As the drill string moves axially through the RCD, it encounters a pliable seal. During the rotary drilling process, the drill string and all connected components are released into the wellbore to maintain bit/rock contact as the formation is excavated. As the joint between two successive sections of pipe reaches the RCD, resistance to axial motion increases as a result of friction between the increased diameter of the pipe joint and the pliable seal of the RCD. This resistance is encountered from the time that the front face of the pipe joint reaches the pliable seal until the rear face of the pipe joint passes through the bottom end of the seal, and may result in one or more perceived and actual changes to drilling parameters as the pipe joint moves through the RCD.

SUMMARY OF THE DISCLOSURE

According to a first aspect of the disclosure, there is provided a method of controlling a drilling operation, comprising: determining that a pipe joint is entering a rotating control device (RCD); in response to determining that the pipe joint is entering the RCD, increasing a weight-on-bit (WOB) setpoint so as to increase a measured WOB; after increasing the WOB setpoint, determining that the pipe joint is exiting the RCD; and in response to determining that the pipe joint is exiting the RCD, decreasing the WOB setpoint so as to decrease the measured WOB.

Determining that the pipe joint is entering the RCD may comprise determining that the measured WOB is less than a first threshold WOB.

The RCD may comprise one or more seals for sealing against the pipe joint, and determining that the pipe joint is entering the RCD may comprise determining that a front of the pipe joint has contacted the one or more seals of the RCD.

The RCD may comprise one or more seals for sealing against the pipe joint, and determining that the pipe joint is exiting the RCD may comprise determining that a rear of the pipe joint is no longer contacting the one or more seals of the RCD.

Determining that the pipe joint is entering the RCD may comprise determining that a measured block height corresponds to a first block height setpoint.

Determining that the pipe joint is exiting the RCD may comprise determining that the measured block height corresponds to a second block height setpoint that is not equal to the first block height setpoint.

The method may further comprise determining the second block height setpoint based on the first block height setpoint and a length of the pipe joint.

The method may further comprise, before determining that the pipe joint is entering the RCD, preventing adjusting of a rate of penetration (ROP) setpoint for at least a portion of a duration that the pipe joint is in the RCD.

The method may further comprise, after determining that the pipe joint is exiting the RCD, allowing adjusting of the ROP setpoint.

Allowing adjusting of the ROP setpoint is performed after decreasing the WOB setpoint.

The method may further comprise: after increasing the WOB setpoint, determining that the measured WOB has not increased to correspond to the increased WOB setpoint; and in response to determining that the measured WOB has not increased to correspond to the increased WOB setpoint: allowing adjusting of the ROP setpoint; after allowing adjusting of the ROP setpoint, increasing the ROP setpoint; and after increasing the ROP setpoint, preventing adjusting of the ROP setpoint for at least a portion of a duration that the pipe joint is in the RCD.

Increasing the WOB setpoint may comprise progressively increasing the WOB setpoint.

Progressively increasing the WOB setpoint may comprise progressively increasing the WOB setpoint from a first point in time wherein a front of the pipe joint has not yet entered the RCD to a second point in time wherein a rear of the pipe joint has entered the RCD.

Decreasing the WOB setpoint may comprise progressively decreasing the WOB setpoint.

Progressively decreasing the WOB setpoint may comprise progressively decreasing the WOB setpoint from a first point in time wherein a front of the pipe joint has not yet exited the RCD to a second point in time wherein a rear of the pipe joint has exited the RCD.

The method may further comprise, during decreasing the WOB setpoint: determining that the measured WOB is less than a second threshold WOB; and in response to determining that the measured WOB is less than the second threshold WOB, increasing an ROP setpoint.

The RCD may comprise a first seal and a second seal for sealing against the pipe joint, determining that the pipe joint is entering the RCD may comprise determining that the pipe joint is contacting the first seal, and the method may further comprise, after increasing the WOB setpoint and before determining that the pipe joint is exiting the RCD: determining that the pipe joint is contacting the second seal; and in response to determining that the pipe joint is contacting the second seal, further increasing the WOB setpoint.

According to a further aspect of the disclosure, there is provided a system for controlling a drilling operation, comprising: a drill string comprising multiple sections of pipe, wherein each pair of successive sections of pipe defines a respective pipe joint; a rotating control device (RCD) forming a seal around the drill string; and one or more RCD mitigators comprising one or more processors configured to perform a method comprising: determining that one of the pipe joints is entering the RCD; in response to determining that the pipe joint is entering the RCD, increasing a weight-on-bit (WOB) setpoint so as to increase a measured WOB; after increasing the WOB setpoint, determining that the pipe joint is exiting the RCD; and in response to determining that the pipe joint is exiting the RCD, decreasing the WOB setpoint so as to decrease the measured WOB.

The method performed by the one or more RCD mitigators may comprise any of the features described above in connection with the first aspect of the disclosure.

According to a further aspect of the disclosure, there is provided a non-transitory computer-readable medium having stored thereon computer program code configured when executed by one or more processors to cause the one or more processors to perform a method comprising: determining that a pipe joint is entering a rotating control device (RCD); in response to determining that the pipe joint is entering the RCD, increasing a weight-on-bit (WOB) setpoint so as to increase a measured WOB; after increasing the WOB setpoint, determining that the pipe joint is exiting the RCD; and in response to determining that the pipe joint is exiting the RCD, decreasing the WOB setpoint so as to decrease the measured WOB.

The method performed by the one or more processors may comprise any of the features described above in connection with the first aspect of the disclosure.

BRIEF DESCRIPTION OF THE DRAWINGS

Embodiments of the disclosure will now be described in detail in conjunction with the accompanying drawings of which.

DETAILED DESCRIPTION

Figure 1:
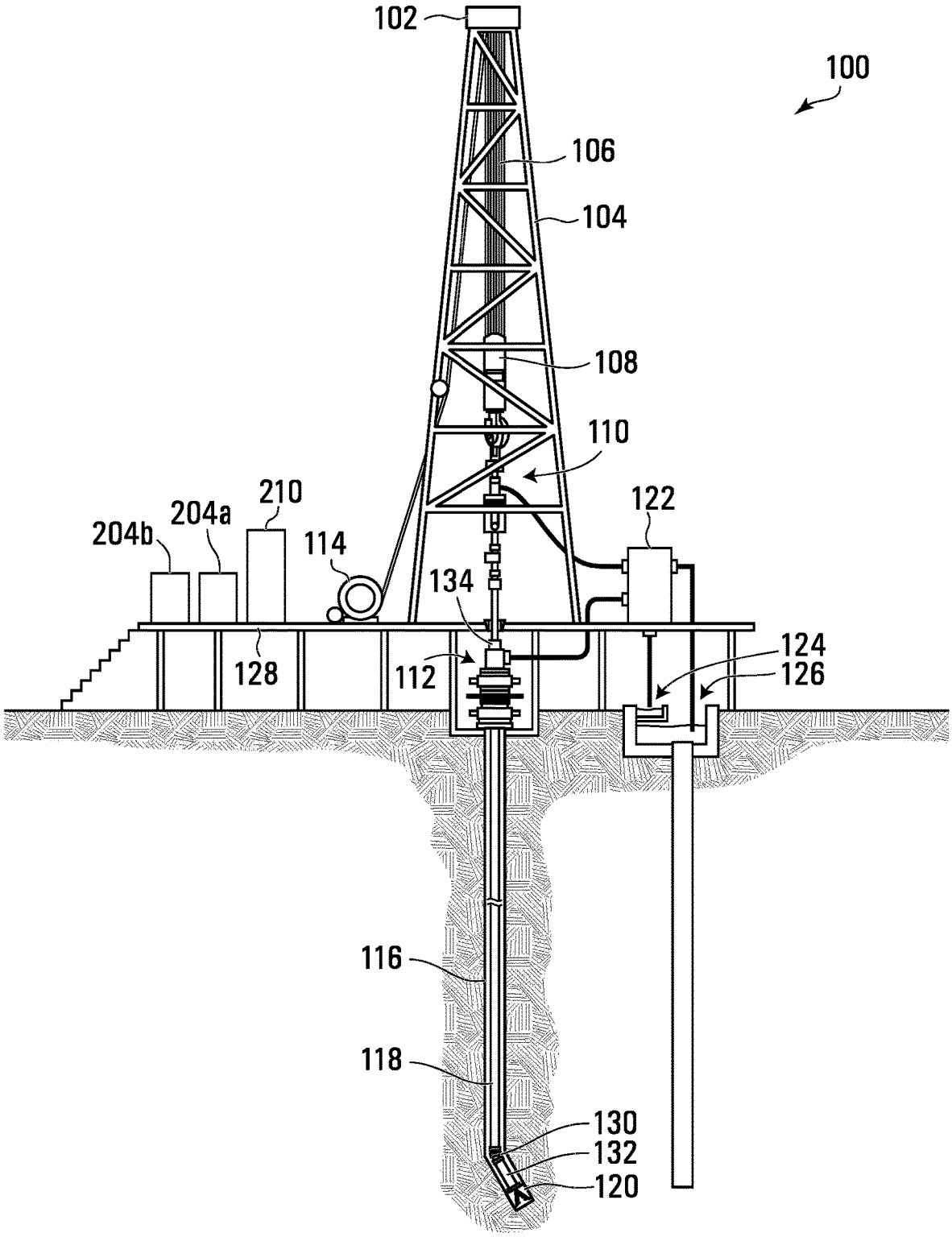
FIG. 1 is a schematic diagram of a drilling rig, according to embodiments of the disclosure.

The present disclosure seeks to provide methods, systems, and computer-readable media for mitigating RCD effects. While various embodiments of the disclosure are described below, the disclosure is not limited to these embodiments, and variations of these embodiments may fall within the scope of the disclosure which is to be limited only by the appended claims.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

The commonly used metric of Weight on Bit (WOB) is a calculated value that approximates the Downhole WOB (DWOB). WOB is derived from the difference between the measured hook load and the calculated weight of the drill string. When the resistance to axial motion increases as the pipe joint passes through an RCD's seal, there is a perceived increase in WOB as some of the hook load is borne by the RCD instead of being transferred to the bit, in addition to an actual decrease in DWOB. When the rear face of the pipe joint passes through the seal, the additional resistance to axial motion is suddenly relieved, and there is a perceived decrease in WOB as well as an actual increase in DWOB.

During drilling operations, it is desirable to maintain a constant DWOB to sustain drill bit cutter engagement and thereby reduce the occurrence of drilling dysfunction such as whirl which can lead to premature wearing of the bit. On the other hand, sudden increases in DWOB may also be detrimental to bit life due to overloading of the cutters. For example, in cases where a resistance to motion is suddenly relieved, such as when the rear face of the pipe joint passes through the RCD, the resultant increase in the drill string rate of release may be significant as the automatic driller attempts to achieve a prescribed WOB setpoint. This in turn may cause a momentary surge in WOB and DWOB.

In some circumstances where a drilling mud motor is being used, the WOB and/or DWOB may increase to a point where the motor may stall, potentially leading to damage to the motor itself. In other circumstances, the changes in observed drilling parameters may lead to erroneously recommended drilling parameters when using drilling optimization software as used, for example, on automatic drillers and/or MSE-based advisory and automation products.

In order to mitigate against the perceived and actual changes to drilling parameters as the pipe joint moves through the RCD, embodiments of the disclosure are generally aimed at an RCD mitigation tool ("RCD mitigator") that may control one or more drilling parameter setpoints as a pipe joint approaches, enters, exits, and moves away from an RCD. According to some embodiments, the RCD mitigator determines that the pipe joint is entering the RCD. For example, the RCD mitigator may determine that a measured block height is equal to a first block height setpoint. In response to determining that the pipe joint is entering the RCD, the RCD mitigator may then clamp (e.g. prevent adjustment of) a rate of penetration (ROP) setpoint, and increases a WOB setpoint so as to increase a measured WOB of the drilling operation. An advantage of increasing the WOB setpoint and corresponding WOB measured at the surface is that decreases in DWOB will be offset when the interaction between the pipe joint and the RCD inhibits the axial motion resulting in incomplete downhole weight transfer. Maintaining a substantially constant DWOB decreases the likelihood and associated risks of bit damage due to dysfunctions such as drill bit whirl and potentially damaging Bottom Hole Assembly (BHA) vibrations.

After increasing the WOB setpoint, the RCD mitigator determines that the pipe joint is exiting the RCD. For example, the RCD mitigator may determine that the measured block height is equal to a second block height setpoint. In response to determining that the pipe joint is exiting the RCD, the RCD mitigator decreases the WOB setpoint so as to decrease the measured WOB of the drilling operation, and may then unclamp the ROP setpoint. Clamping the ROP setpoint may force the automated drilling unit to keep WOB from exceeding the WOB setpoint—this is why the clamp on the ROP setpoint is removed last. An advantage of decreasing the WOB setpoint is that excessive WOB and corresponding downhole WOB are prevented from being suddenly applied to the drill bit when the pipe joint exits the RCD.

Turning to FIG. 1, there is shown a drilling rig 100 according to an embodiment of the disclosure. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. Rotating the drawworks 114 consequently is able to change weight on bit (WOB) during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the mud tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126. A Rotating Control Device (RCD) 134 is located on top of BOP 112.

Figure 2:
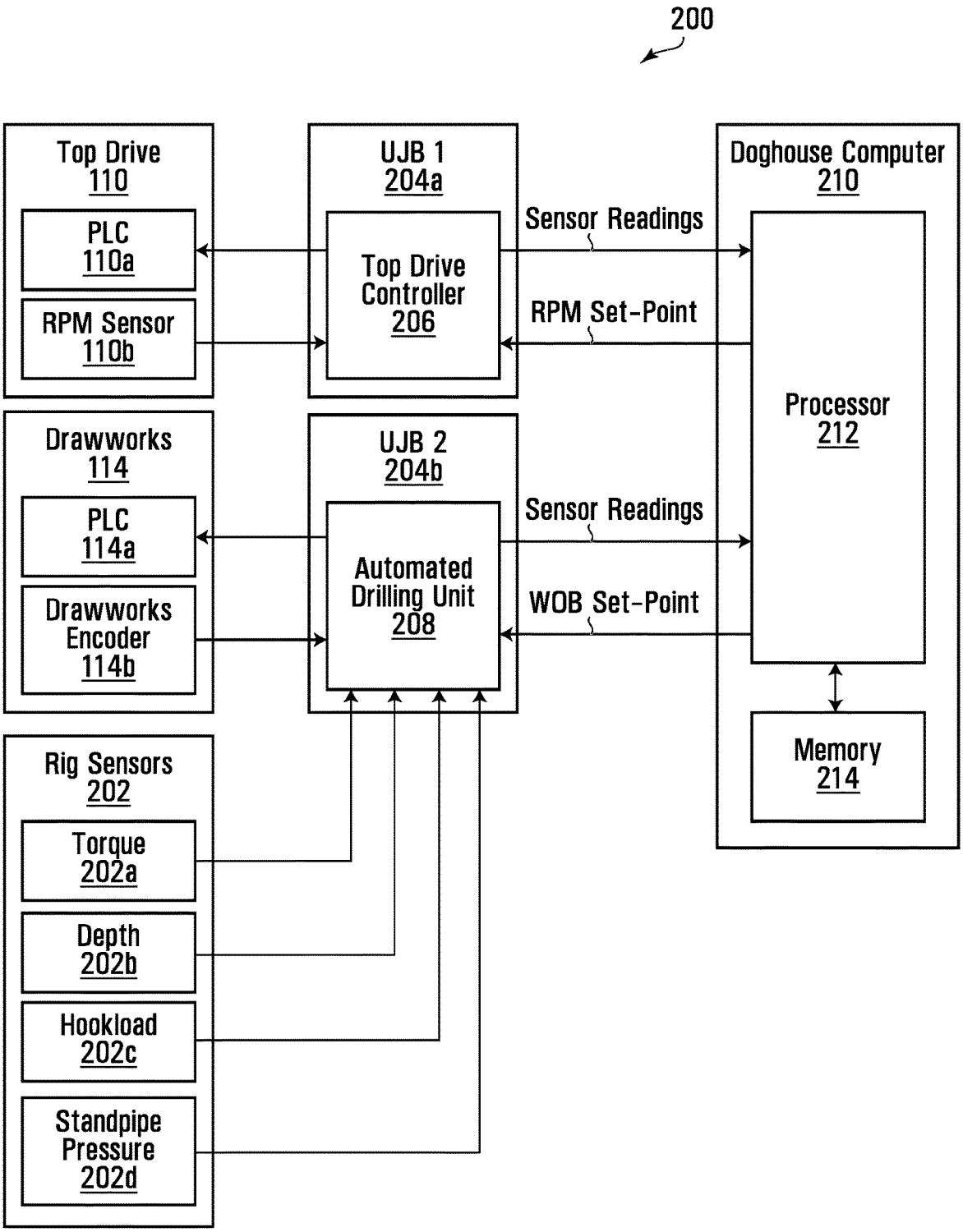
FIG. 2 is a block diagram of a system for performing automated drilling of a wellbore, according to embodiments of the disclosure.

FIG. 2 shows a block diagram of a system 200 for performing automated drilling of a wellbore, according to the embodiment of FIG. 1. The system 200 comprises various rig sensors: a torque sensor 202*a*, a depth sensor 202*b*, a hookload sensor 202*c*, and a standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and an RPM sensor 110*b* that outputs the rotational rate of the drill string 118. More generally, the top drive PLC 110*a* is an example of a rotational drive unit controller and the RPM sensor 110*b* is an example of a rotation rate sensor.

A first junction box 204*a* houses a top drive controller 206 which is communicatively coupled to the top drive PLC 110*a* and the RPM sensor 110*b*. The top drive controller 206 controls the rotation rate of the drill string 118 by instructing the top drive PLC 110*a* and obtains the rotation rate of the drill string 118 from the RPM sensor 110*b*.

A second junction box 204*b* houses an automated drilling unit 208 (e.g., an automatic driller), which is communicatively coupled to the drawworks PLC 114*a* and the drawworks encoder 114*b*. The automated drilling unit 208 modulates WOB during drilling by instructing the drawworks PLC 114*a*, and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the rate of penetration (ROP) of the drill bit 120 by monitoring the height of the traveling block 108 over time.

The system 200 also comprises a doghouse computer 210. The doghouse computer 210 comprises a processor 212 and memory 214 communicatively coupled to each other. The memory 214 stores computer program code that is executable by the processor 212 and that, when executed, causes the processor 212 to perform automated drilling of the wellbore 116 by providing inputs to top drive controller 206 and automated drilling unit 208. The processor 212 receives readings from the RPM sensor 110*b*, drawworks encoder 114*b*, and the rig sensors 202, and sends an RPM target ("RPM setpoint") and a WOB target ("WOB setpoint") to the top drive controller 206 and automated drilling unit 208, respectively. The top drive controller 206 and automated drilling unit 208 relay these targets to the top drive PLC 110*a* and drawworks PLC 114*a*, respectively, where they are used for automated drilling. More generally, the RPM target is an example of a rotation rate target.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 110, automated drilling unit 208, and doghouse computer 210 collectively comprise an example type of drilling controller. In different embodiments, however, the drilling controller may comprise different components connected in different configurations. For example, in the system 200 of FIG. 2, the top drive controller 110 and the automated drilling unit 208 are distinct and respectively use the RPM target and WOB target for automated drilling. However, in different embodiments (not depicted), the functionality of the top drive controller 206 and automated drilling unit 208 may be combined or may be divided between three or more controllers. In certain embodiments (not depicted), the processor 212 may directly communicate with any one or more of the top drive 110, drawworks 114, and sensors 202. Additionally or alternatively, in different embodiments (not depicted) automated drilling may be done in response to only the RPM target, only the WOB target, one or both of the RPM and WOB targets in combination with additional drilling parameters, or targets based on drilling parameters other than RPM and WOB. Examples of these additional drilling parameters comprise differential pressure, an ROP target, depth of cut, torque, mechanical specific energy (MSE), and flow rate (into the wellbore 116, out of the wellbore 116, or both).

In the depicted embodiments, the top drive controller 110 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 110 and the automated drilling unit 208 may sample data at different rates, and more generally in embodiments in which different equipment is used data may be sampled from different sensors 202 at different rates.

Figure 3:
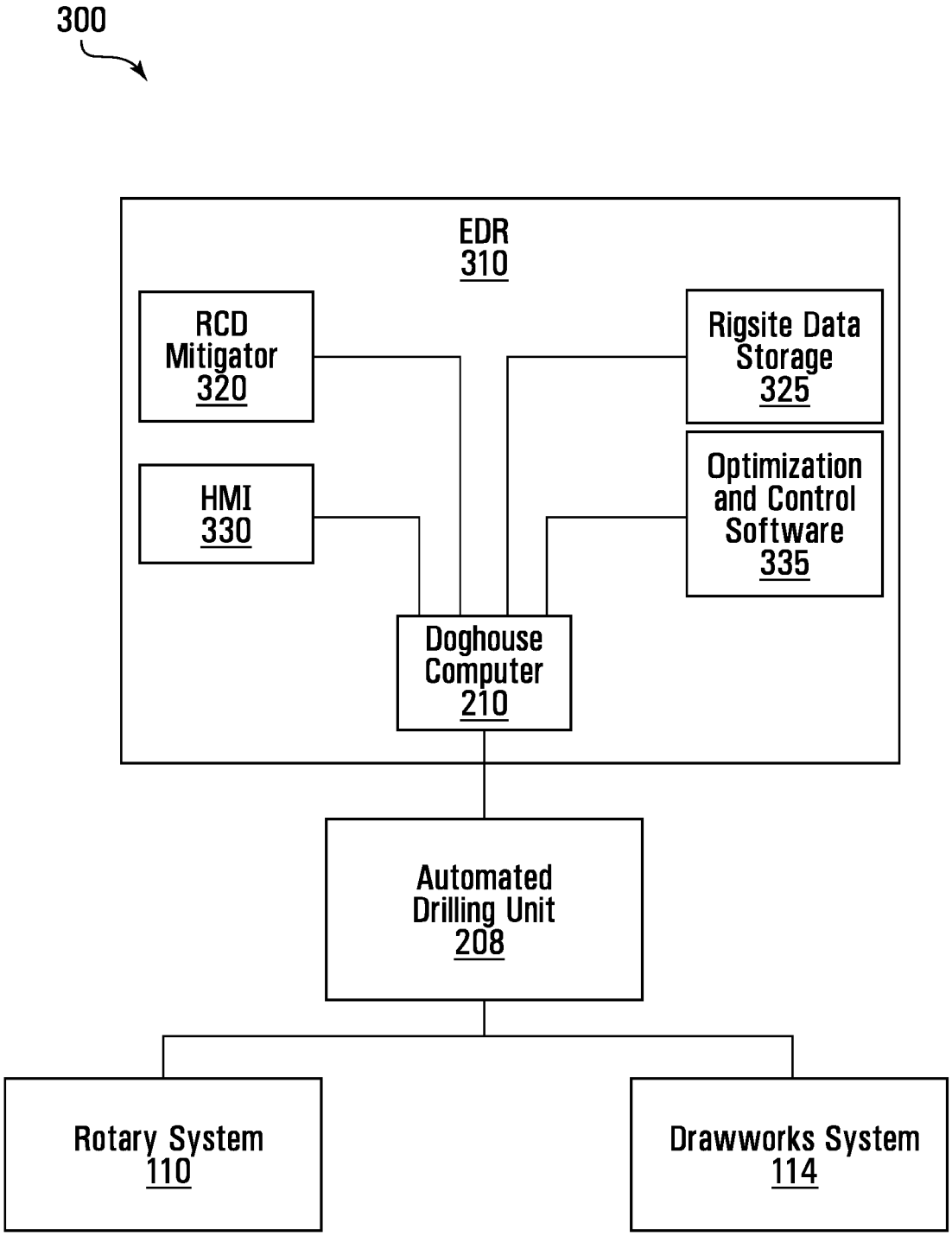
FIG. 3 is a block diagram of a system for mitigating the effects of an RCD on measured drilling parameters as a pipe joint moves through the RCD ("mitigating RCD effects"), according to embodiments of the disclosure.

Turning to FIG. 3, there is shown a block diagram of a system 300 for performing RCD mitigation. Within the context of the present disclosure, RCD mitigation may refer to a process that mitigates the observable effect or effects on measured drilling parameters (in particular WOB) as a pipe joint passes axially through RCD 134, as described in further detail below. System 300 includes an electronic drilling recorder (EDR) 310 comprising an RCD mitigator 320, Human Machine Interface (HMI) 330, rigsite data storage 325, optimization and control software 335, and doghouse computer 210. Doghouse computer 210 collects sensor readings from UJB 204*b* (FIG. 2). The sensor readings (which may be referred to as drilling parameters) include RPM, WOB, differential pressure, torque, travelling block height (or simply "block height"), and depth, and may be derived directly from the measurements obtained by the sensors. Other drilling parameters may be derived from RPM, WOB, differential pressure, and torque. For example, bit torque may be derived from differential pressure times the ratio of a maximum torque of the mud motor to a maximum differential pressure of the mud motor. Doghouse computer 210 processes the sensor readings into a stream of sensor data, and RCD mitigator 320 is configured to receive the sensor data from doghouse computer 210. Based on the sensor data, RCD mitigator 320 may adjust one or more drilling parameter setpoints, such as the WOB setpoint. RCD mitigator 320 may furthermore prevent further adjustment of one or more other drilling parameters, such as the ROP setpoint, by "clamping" such setpoints. Clamping setpoints ensures that the associated drilling parameters are maintained at their current values. If the setpoints are not set beforehand, they remain un-set. If the setpoints are set during the RCD mitigation process, they remain fixed throughout the process unless they are required to be set to different values so that other drilling parameters of interest may achieve their respective setpoints.

Adjusted drilling parameter setpoints are communicated to doghouse computer 210 and are sent from doghouse computer 210 to automated drilling unit 208. Automated drilling unit 208 may then control the drilling operation based on the updated drilling parameter setpoints, by controlling a rotary system (e.g., top drive 110) and a drawworks system (e.g., drawworks 114).

Figure 4:
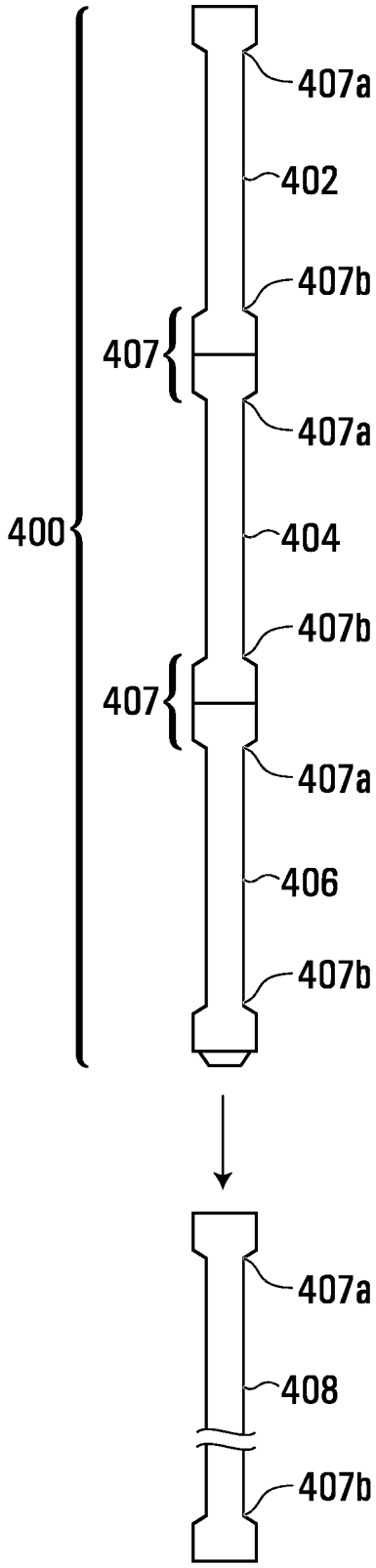
FIG. 4 is a schematic diagram of a stand of pipe being added to a drill string, according to embodiments of the disclosure.

Turning to FIG. 4, there is shown a schematic of a drill string comprising multiple, interconnected sections or lengths of pipe forming a stand of pipe. A "stand" refers to a number of drill pipe sections connected together by joints at ends of the drill pipe sections. FIG. 4 shows an embodiment in which a stand 400 comprises three lengths of pipe 402, 404, and 406. Generally, a stand includes two or three lengths of pipe that are screwed together, but four or more lengths of pipe are also possible based on the particular rig design, capacity, and drilling conditions. In FIG. 4, stand 400 connects to a drill string that is already in the wellbore. In the newly formed connection, pipe length 408 connects to pipe length 406 of stand 400. After the connection, a pipe joint 407 is formed by the interconnection of pipe length 406 with pipe length 408. A front edge 407*a* of pipe joint 407 defines the advancing part or front of pipe joint 407, and a rear edge 407*b* of pipe joint 407 defines the trailing portion or rear of pipe joint 407. The front and rear portions of pipe joint 407 are generally tapered.

During a connection while drilling forward, the driller adds a new stand of pipe (such as stand 400) to the surface end of the drill string. Once the new stand is added, the driller allows the drill string to advance axially by adjusting the rate at which the drill string is permitted to advance, either manually through a brake handle or by using automated drilling unit 208 which determines the rate of advancement. This advancement leads to an increase in WOB and corresponding DWOB, and allows the drill bit to drill forward.

Figure 5A:
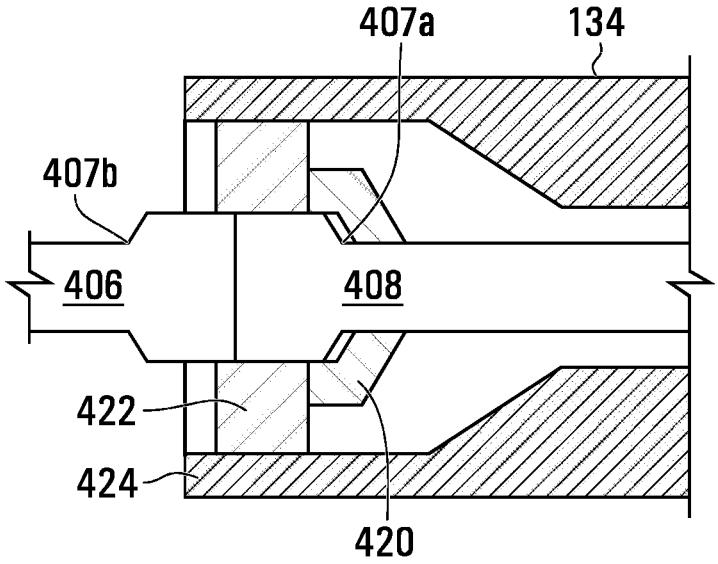
FIGS. 5A-5C are schematic diagrams of respectively a pipe joint about to enter, having entered, and having exited an RCD, according to embodiments of the disclosure.

Turning to FIG. 5A, there is now shown a schematic of pipe joint 407 (formed by the interconnection of pipe length 406 with pipe length 408) entering RCD 134. RCD 134 comprises an RCD seal 420 forming a seal around the drill string as the drill string moves axially through RCD 134. RCD 134 further comprises an inner member 422 and an outer member 424. A bearing (not shown) is provided between inner member 422 and outer member 424. In operation, seal 420 and inner member 422 rotate with the drill string while outer member 424 does not.

During a drilling operation, the driller enters into an electronic drilling recorder, such as doghouse computer 210, the dimensions of the drill pipe that is being used. In particular, the length of pipe joint 407 (i.e. the distance from front edge 407*a* of pipe joint 407 to rear edge 407*b* of pipe joint 407) is entered, as is the length of pipe section 406. As the drill string moves axially through RCD 134, the driller inputs the point in time at which front edge 407*a* of pipe joint 407 contacts RCD seal 420. This defines H1, the height of the travelling block corresponding to front edge 407*a* of pipe joint 407 contacting RCD seal 420 (corresponding to FIG. 5A). The axial position that is entered into doghouse computer 210 is relative to the position of the travelling block when the position of front edge 407*a* is recorded. Subsequent pipe joint edges may be calculated based on the recorded front edge 407*a* together with the recorded length of pipe joint 407.

Figure 5B:
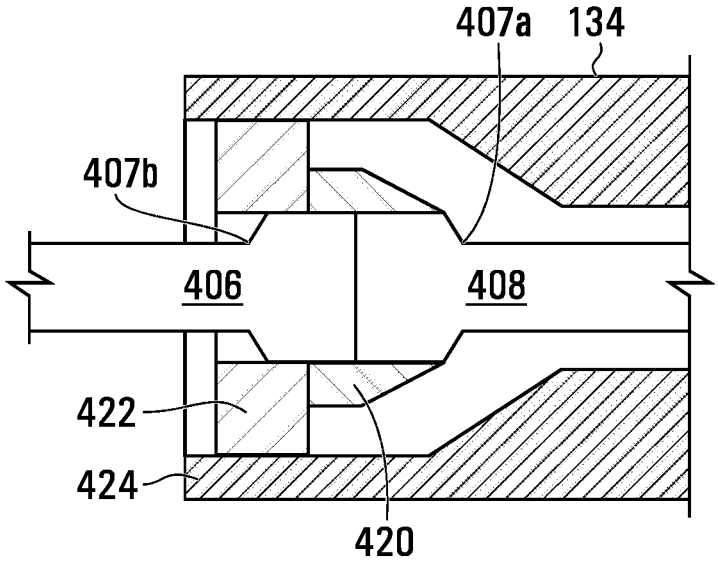

RCD mitigator 320 may then determine the distance that the drill string must advance before the entirety of pipe joint 407 as defined by front edge 407*a* and rear edge 407*b* has moved clear of RCD seal 420. FIG. 5B represents a point in time when pipe joint 407 is still within RCD 134 but rear edge 407*b* of pipe joint 407 has not yet exited RCD 134.

If the specific lengths of pipe sections 406 and 408, and pipe joint 407, have not been entered, then RCD mitigator 320 may use default values. Alternatively, RCD mitigator 320 may auto-calibrate by determining the length of stand 400 from changes in travelling block position over previous stands, and may detect reference patterns in drilling parameters to identify the positions of front edge 407*a* and rear edge 407*b* of pipe joint 407.

If the distance from the top of RCD seal 420 to the rig floor is known, then an offset distance between the top of RCD seal 420 and front edge 407*a* of pipe joint 407 may be entered to define H1.

When drilling begins, new drilling parameter setpoints are entered into automated drilling unit 208 that controls the drilling of the wellbore. Included in the drilling parameter setpoints are WOB and ROP setpoints. Automated drilling unit 208 ensures that drilling parameters do not exceed the user-entered drilling parameter setpoints, or drilling parameter setpoints provided by optimization and control software 335 with closed-loop control.

Figure 5C:
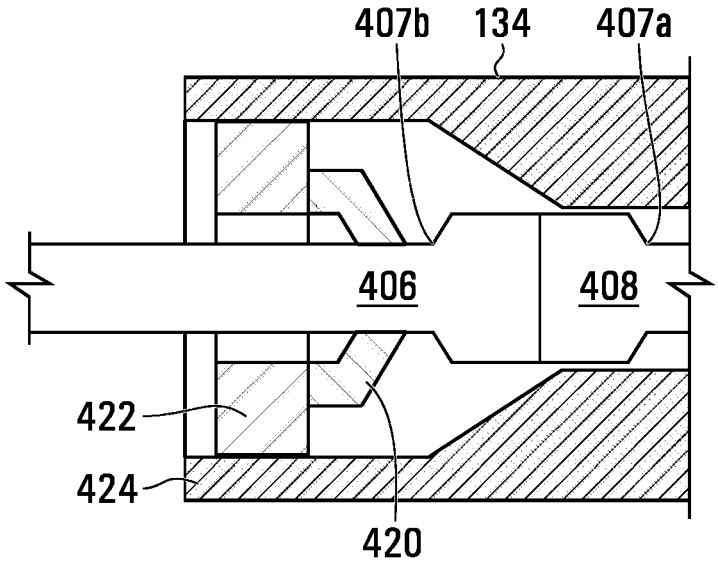

As the drill string moves further through RCD 134, the point in time at which rear edge 407*b* of pipe joint 407 no longer contacts RCD seal 420 (corresponding to FIG. 5C) is recorded. This defines H2, the height of the travelling block corresponding to rear edge 407*b* of pipe joint 407 no longer contacting RCD seal 420. The axial position that is entered into doghouse computer 210 is relative to the position of the travelling block when the position of rear edge 407*b* is recorded.

Figure 6:
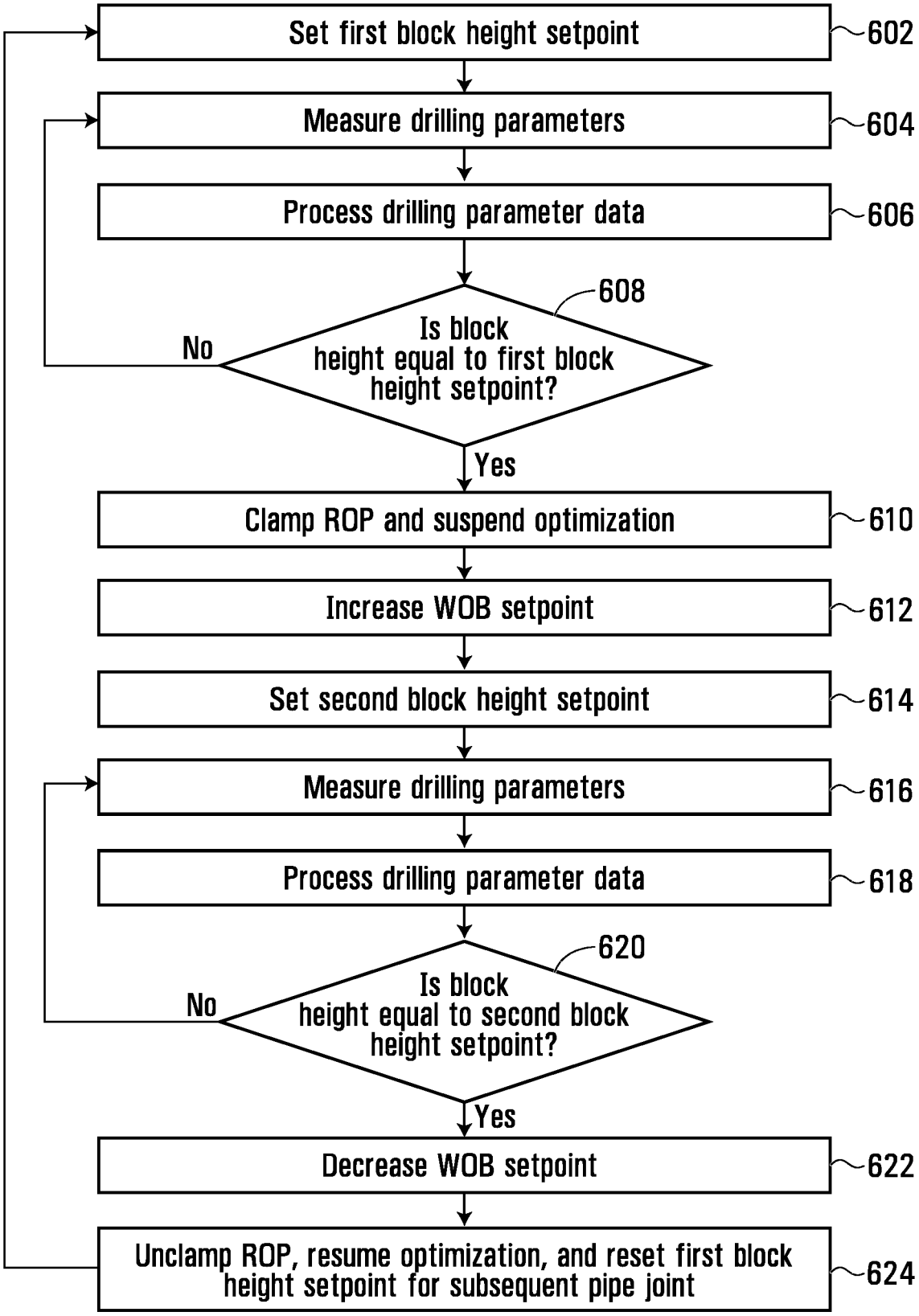
FIG. 6 is a flow diagram of a method for mitigating RCD effects, according to embodiments of the disclosure.

Turning to FIG. 6, there is shown a flow diagram illustrating a method of RCD mitigation, according to embodiments of the disclosure.

At block 602, a first block height setpoint (corresponding to H1) is input to RCD mitigator 320 to enable RCD mitigator 320 to determine when the RCD mitigation process is to begin. As explained above, the first block height setpoint may be calculated based on the current block height and based on the distance remaining until the next front edge of the next tool joint (e.g. front edge 407*a* of pipe joint 407) contacts RCD seal 420. This can generally be the offset between the block height corresponding to the connection position and the block height corresponding to when front edge 407*a* of pipe joint 407 contacts RCD seal 420. Alternatively, the user may manually enter the block height setpoint as front edge 407*a* of pipe joint 407 contacts RCD seal 420.

At block 604, drilling parameters are measured, and at block 606 the measured drilling parameters are processed into drilling parameter data. In particular, at block 606, a local average ROP is calculated based on a windowed subset of calculated ROP collected immediately prior to the window in question. The windowed subset is based on a predetermined period of time before the calculation of the local average ROP, to provide a stable value indicative of current drilling conditions. The windowed subset may relate to a fixed time amount, or may be dependent on depth and ROP, and may account for pipe stretch. In the event that there is insufficient data to determine a local average ROP due to insufficient setpoint tracking which may be attributable to variable formation geology, poor tuning of automated drilling unit 208, or a short amount of time between when pipe joint 407 first enters RCD 134 following a connection, the following may be used instead: the instant ROP, a generic best practice average ROP, or the average ROP used during the most recent instance of a drill pipe joint passing through RCD 134.

At block 608, the current block height is compared to the first block height setpoint. If the current block height has not yet reached (e.g. is within a predetermined threshold of) the first block height setpoint, then drilling continues with no changes and the process returns to block 604. If the current block height has reached (e.g. is within a predetermined threshold of) the first block height setpoint, then, at block 610, the ROP setpoint is "clamped" (i.e. fixed) by RCD mitigator 320 at the most recently calculated local average ROP, and is prevented from being further adjusted. In addition, RCD mitigator 320 suspends optimization and control software 335 that may be in operation. This is because the mitigation of RCD 134 may be considered a different mode of drilling operation than that for which optimization and control software 335 was designed. As such, the data acquired during the RCD mitigation process may negatively impact the calculations made by optimization and control software 335, and vice versa. In cases where optimization and control software 335 is performing closed-loop control of drilling parameter setpoints, suspension of optimization and control software 335 allows RCD mitigator 320 to have control of the necessary setpoints.

At block 612, RCD mitigator 320 increases the WOB setpoint. The increase in the WOB setpoint corresponds to the amount of ROP increase that is required to overcome the friction encountered as pipe joint 407 passes through RCD seal 420 so as to ensure that the DWOB is substantially unchanged as the drill string passes through RCD 134. The amount by which the WOB setpoint is increased may be a configurable parameter with a predetermined default value. The increase in the WOB setpoint further ensures that the current WOB value does not exceed the WOB setpoint when front edge 407*a* of pipe joint 407 contacts RCD seal 420. If the current WOB value exceeds the WOB setpoint, then automated drilling unit 208 will take action to reduce the payout which allows for the DWOB to drill off and allows the corresponding surface WOB to decrease until the WOB value no longer exceeds the WOB setpoint. In some cases, the WOB is unable to reach the increased WOB setpoint due to the level at which ROP was clamped. In other words, the rate of payout by automated drilling unit 208 may not be sufficient to overcome the friction encountered as pipe joint 407 passes through RCD 134. In this case, the clamping of the ROP setpoint may be temporarily suspended and the ROP setpoint may be increased by RCD mitigator 320 to allow the WOB to reach the WOB setpoint.

At block 614, a second travelling block height setpoint (corresponding to H2) is determined based on the length of pipe joint 407. The second block height setpoint, H2, corresponds to the first block height setpoint, H1, minus the length of pipe joint 407 (defined as the distance between front edge 407*a* and rear edge 407*b*).

At block 616, drilling parameters are measured, and at block 618 the measured drilling parameters are processed into drilling parameter data. At block 620, the current block height is compared to the second block height setpoint. If the current block height has not yet reached (e.g. is within a predetermined threshold of) the second block height setpoint, then drilling continues with no changes and the process returns to block 616. If the current block height has reached (e.g. is within a predetermined threshold of) the second block height setpoint, then, at block 622, RCD mitigator 320 reverts the WOB setpoint to its initial value (e.g. its value before pipe joint 407 entered RCD 134). At block 624, RCD mitigator 320 unclamps the ROP setpoint, and the operation of optimization and control software 335 that was previously suspended is resumed. The process then returns to block 602.

According to some embodiments, the WOB setpoint is increased as the measured block height approaches the first block height setpoint, in order to avoid having insufficient WOB once the additional friction of pipe joint 407 passing through RCD 134 is felt, otherwise potentially causing a spike in DWOB. For example, the WOB setpoint may begin being increased when front edge 407*a* of pipe joint 407 approaches the entrance of RCD 134.

According to some embodiments, the WOB setpoint is decreased as the measured block height approaches the second block height setpoint, in order to avoid having excess WOB once the additional friction of pipe joint 407 passing through RCD 134 is removed, otherwise potentially causing a spike in DWOB. For example, the WOB setpoint may begin being decreased when rear edge 407*b* of pipe joint 407 approaches the exit of RCD 134.

According to some embodiments, if the measured WOB drops more than a threshold amount (e.g. if the WOB drops below an average WOB as determined before the RCD mitigation process began), then RCD mitigator 320 may increase the ROP setpoint to allow automated drilling unit 208 to apply more WOB, therefore keeping DWOB constant and avoiding whirl that may be induced by insufficient DWOB.

Figure 7:
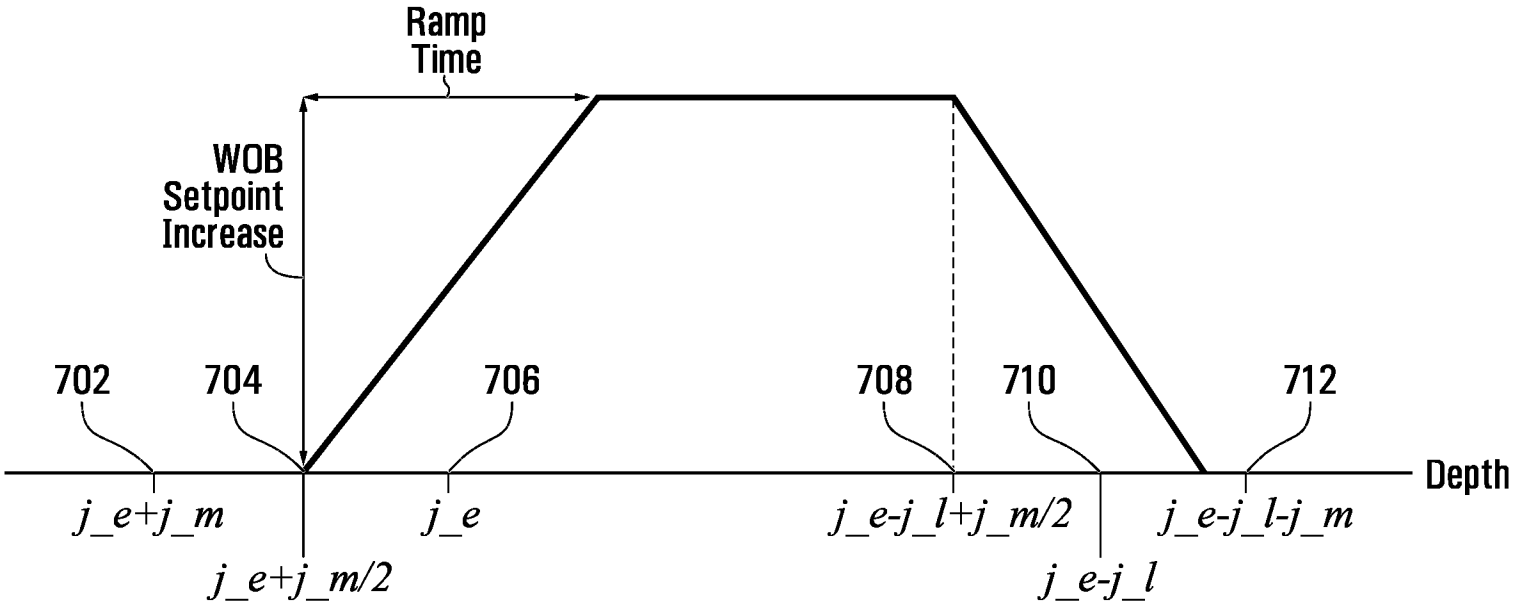
FIG. 7 is a plot of a WOB setpoint as a pipe joint enters and exits an RCD, according to embodiments of the disclosure.

According to some embodiments, and as shown in FIG. 7, the clamping of the ROP setpoint may be initiated before the WOB setpoint is increased. A margin $j_m$ may be determined by the user or can be selected by RCD mitigator 320. $j_m$ may be selected or determined to account for measurement errors, the length of RCD seal 420, variance between pipes, etc. At 702, the ROP setpoint may be clamped at a point corresponding to an amount $j_m$ before the entry of pipe joint 407 into RCD 134. At 704, the WOB setpoint is then increased, for example linearly, from the calculated pipe joint entry plus $j_m/2$. The calculated exit point 710 corresponds to the pipe joint entry minus the length of pipe joint 407. At 708, the WOB setpoint is then decreased, for example linearly, from a point corresponding to the pipe joint entry minus the length of pipe joint 407 plus $j_m/2$. At 712, the ROP setpoint is then unclamped at a point that corresponds to the pipe joint entry minus the length of pipe joint 407 and minus $j_m$. The reduction of the WOB setpoint is set to be completed before the ROP setpoint is unclamped. In FIG. 7, $j_e$ is the calibrated entry 706 of joint edge 407*a* into RCD 134, $j_1$ is the length of pipe joint 407, and the calculated exit 710 of joint edge 407*a* out of RCD 134 is $j_e$-$j_1$.

Figure 8:
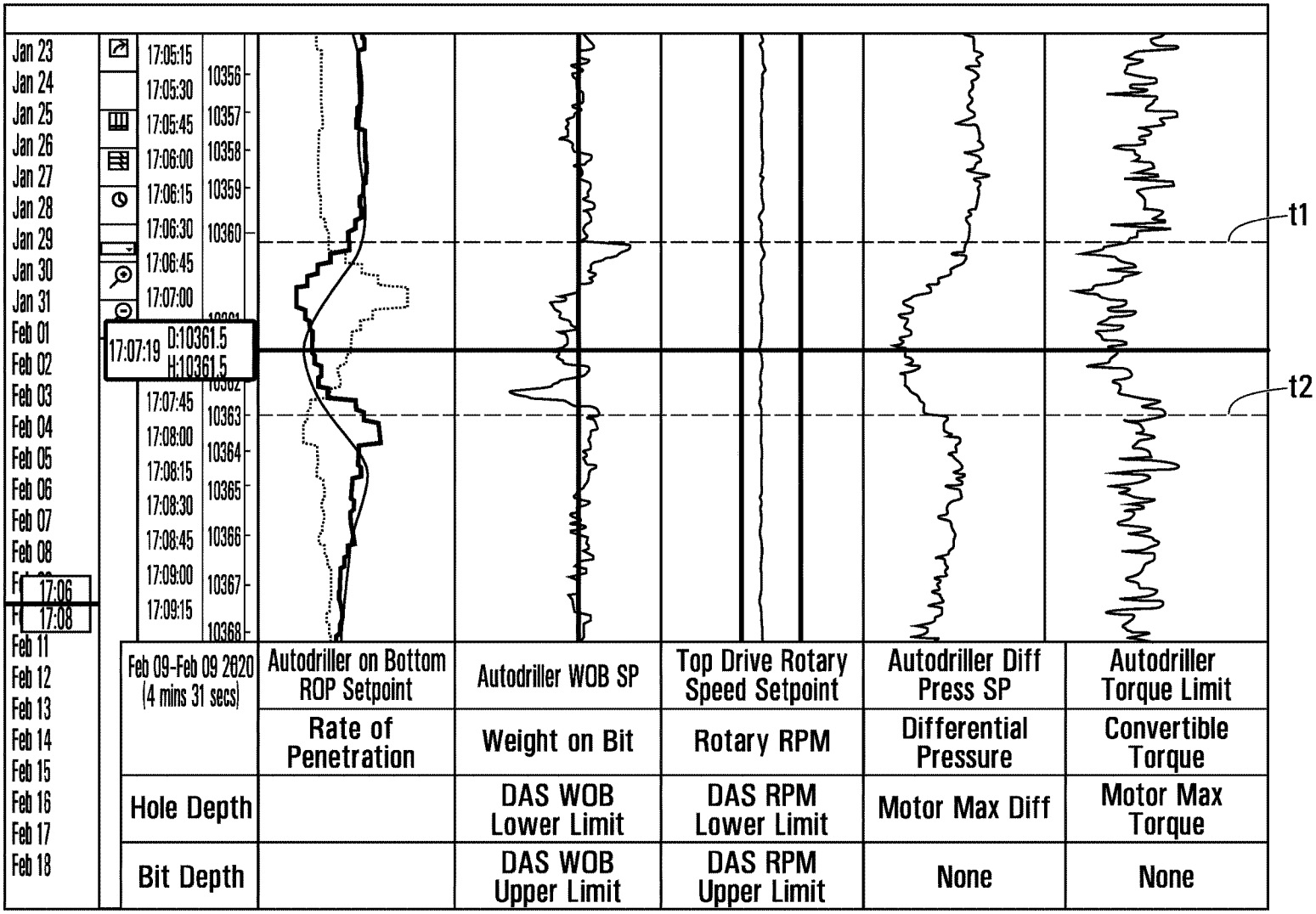
FIG. 8 shows plots of drilling parameters without RCD mitigation, according to embodiments of the disclosure.

Turning to FIG. 8, there are shown traces of drilling parameters without RCD mitigation. The effect of pipe joint 407 passing through RCD 134 can be seen between times t1 and t2. An increase in measured WOB is seen at t1, and automated drilling system 208 and optimization and control software 335 attempt to correct for the increase in measured WOB. As a result, there is a drop in measured WOB as pipe joint 407 passes through RCD 134. The lasting effect of pipe joint 407 passing through RCD 134 can be seen in the optimization traces for a considerable time after t2. Likewise, the measured differential pressure is seen to fluctuate significantly between t1 and t2. Differential pressure may be defined as the difference between the pressure of the fluid in the drill pipe and a benchmark value measured when the drill bit is off bottom. Differential pressure may be used as a proxy for DWOB.

Figure 9:
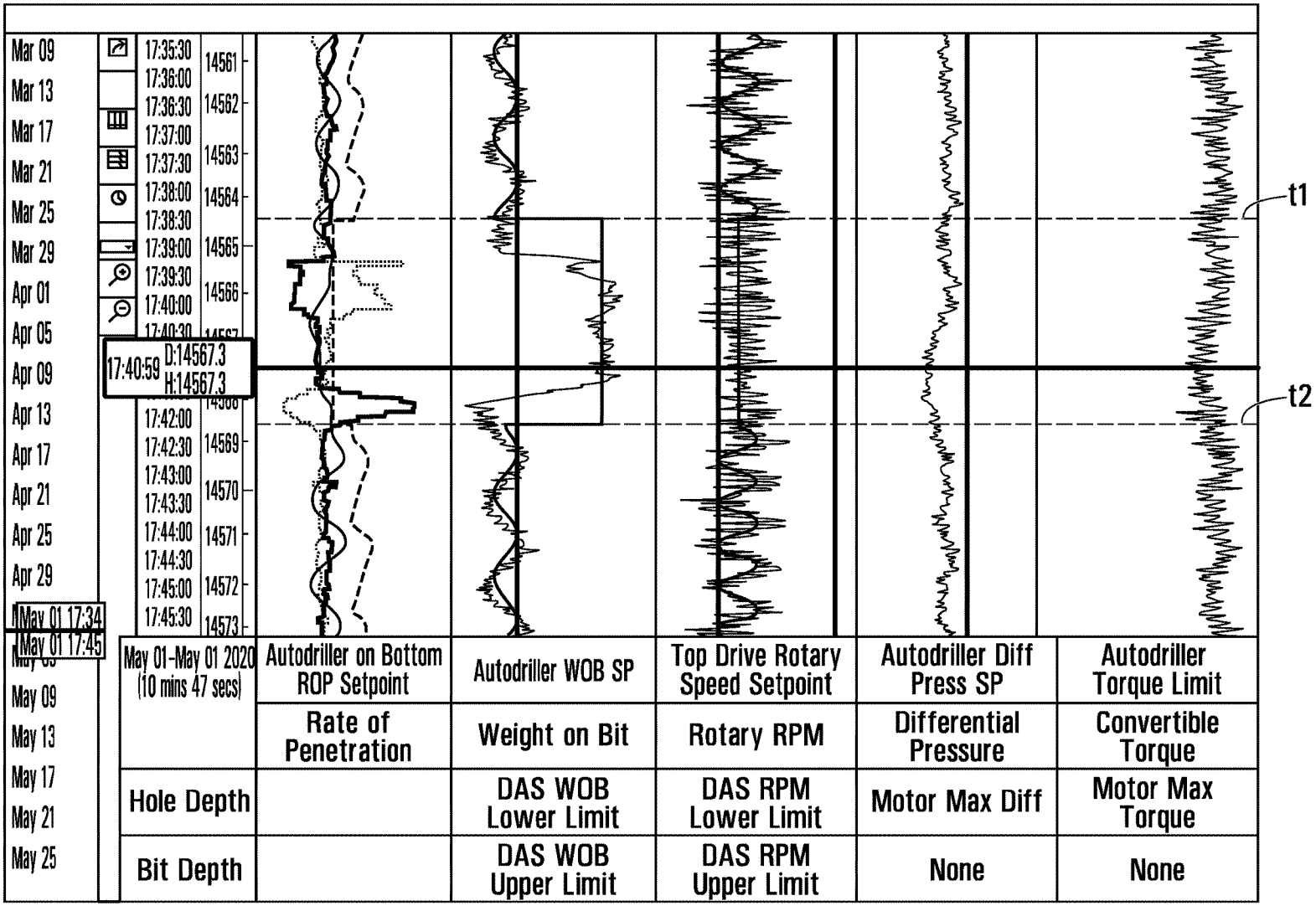
FIG. 9 shows plots of drilling parameters with non-ramped RCD mitigation, according to embodiments of the disclosure.

In FIG. 9, a drilling rig is operating with RCD mitigator 320. As pipe joint 407 passes through RCD 134, the WOB setpoint is increased from t1 to t2. In contrast to FIG. 8, the differential pressure, and therefore DWOB, remains relatively stable as pipe joint 407 passes through RCD 134. Maintaining a relatively constant DWOB mitigates the risks of drilling dysfunction, for example drill bit whirl and vibrations, which can lead to damage to bits and BHA equipment. The optimization traces are paused between t1 and t2.

Figure 10:
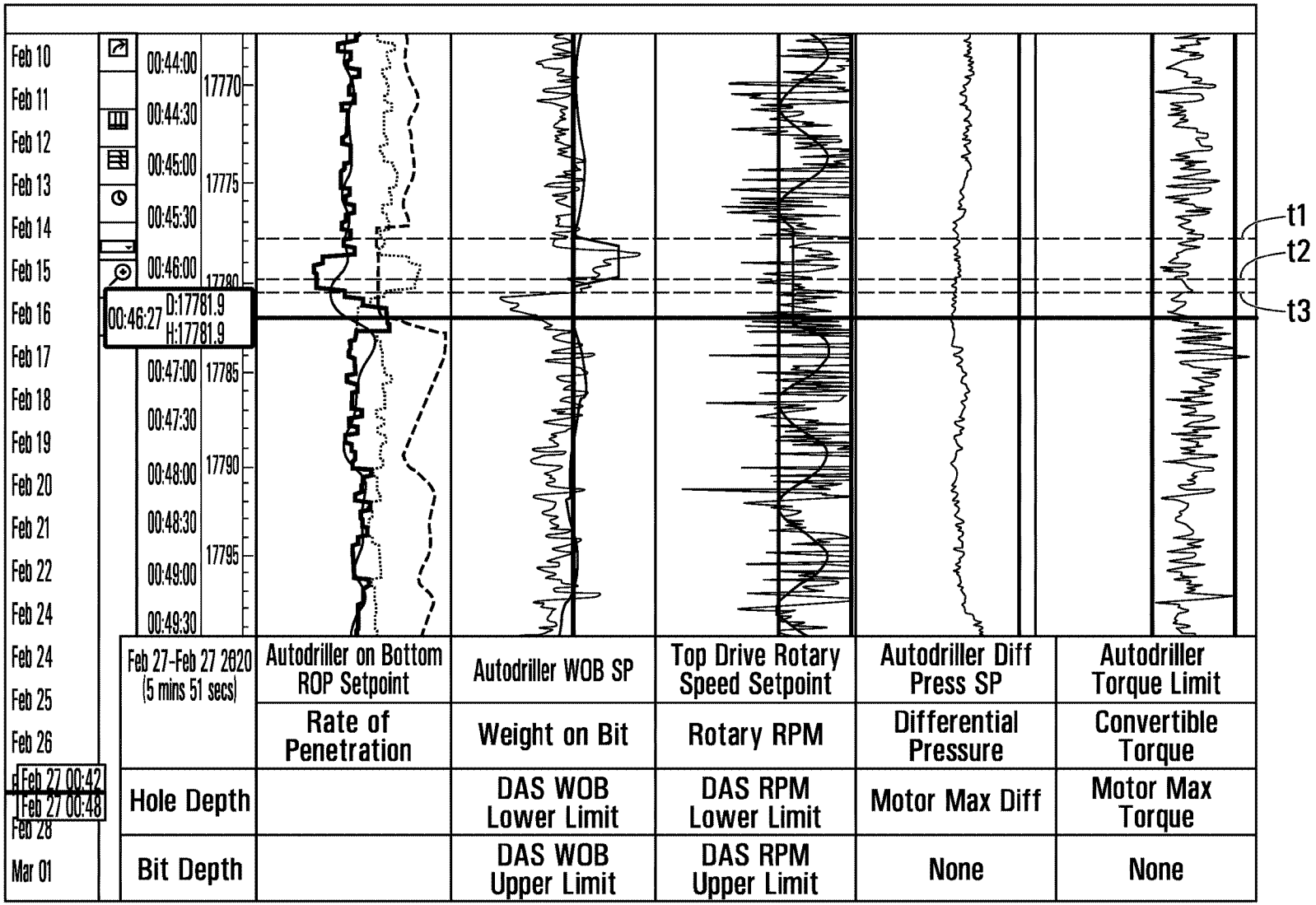
FIG. 10 shows plots of drilling parameters with ramped RCD mitigation, according to embodiments of the disclosure.

In FIG. 10, a drilling rig is operating with RCD mitigator 320 configured to gradually increase and decrease the WOB setpoint, as described above in connection with FIG. 7. Just before t1, the control software (automated drilling unit 208 on the bottom ROP setpoint) is halted. At t1, the WOB setpoint is gradually increased, and operation of optimization and control software 335 is halted. At t2, as pipe joint 407 approaches the exit of RCD 134, the WOB setpoint begins to be returned to its original value. At t3, the WOB setpoint is restored and optimization and control software 335 is reactivated. Just after t3, the control software (automated drilling unit 208 on the bottom ROP setpoint) is resumed. Again, the differential pressure measurements remain stable.

According to some embodiments, RCD mitigator 320 may be an automated system. In such a system, the driller does not need to manually enter the length of the pipe, nor the length of pipe joint 407, nor identify when front edge 407*a* of pipe joint 407 contacts RCD seal 420. In an automated mode, RCD mitigator 320 may identify the initial contact of front edge 407*a* pipe joint 407 with RCD seal 420 by identifying a drop in WOB associated with the increased friction of pipe joint 407 passing through RCD seal 420. RCD mitigator 320 may then estimate the length of pipe joint 407 based on industry standards or previously observed results. For successive pipe joints within a stand, RCD mitigator 320 may use previously observed results to inform estimates for the first and second block height setpoints, H1 and H2.

According to some embodiments, RCD 134 may comprise a plurality of seals. In this case, the driller may input to RCD mitigator 320 respective distances between successive seals. If the distance between successive seals exceeds the length of pipe joint 407, then RCD mitigator 320 may treat the seals as two separate events. If the distance between successive seals is less than the length of pipe joint 407, then RCD mitigator 230 may treat the seals as a single, larger event. In this case, it may be necessary to further increase the WOB setpoint when more than one seal is engaged with pipe joint 407.

According to some embodiments, a pipe joint may not have a standard length. For example, a specialty sub that is significantly shorter than a typical stand may be included in the drill string. In this case, the driller may enter a "one-time" special length for the non-standard pipe joint so that RCD mitigator 320 may accommodate the non-standard joint length.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

It is furthermore contemplated that any part of any aspect or embodiment discussed in this specification can be implemented or combined with any part of any other aspect or embodiment discussed in this specification.

The invention claimed is:

1. A method of controlling a drilling operation, comprising:

determining that a pipe joint is entering a rotating control device (RCD);

in response to determining that the pipe joint is entering the RCD, increasing a weight-on-bit (WOB) setpoint so as to increase a measured WOB;

after increasing the WOB setpoint, determining that the pipe joint is exiting the RCD; and in response to determining that the pipe joint is exiting the RCD, decreasing the WOB setpoint so as to decrease the measured WOB.

2. The method of claim 1, wherein the RCD comprises one or more seals for sealing against the pipe joint, and wherein determining that the pipe joint is entering the RCD comprises determining that a front of the pipe joint has contacted the one or more seals of the RCD.

3. The method of claim 1, wherein determining that the pipe joint is entering the RCD comprises determining that a measured block height corresponds to a first block height setpoint.

4. The method of claim 3, wherein determining that the pipe joint is exiting the RCD comprises determining that the measured block height corresponds to a second block height setpoint that is not equal to the first block height setpoint.

5. The method of claim 4, further comprising determining the second block height setpoint based on the first block height setpoint and a length of the pipe joint.

6. The method of claim 1, further comprising, before determining that the pipe joint is entering the RCD, preventing adjusting of a rate of penetration (ROP) setpoint for at least a portion of a duration that the pipe joint is in the RCD.

7. The method of claim 6, further comprising, after determining that the pipe joint is exiting the RCD, allowing adjusting of the ROP setpoint.

8. The method of claim 1, wherein increasing the WOB setpoint comprises progressively increasing the WOB setpoint.

9. A system for controlling a drilling operation, comprising:

a drill string comprising multiple sections of pipe, wherein each pair of successive sections of pipe defines a respective pipe joint;

a rotating control device (RCD) forming a seal around the drill string; and one or more RCD mitigators comprising one or more processors configured to perform a method comprising:

determining that one of the pipe joints is entering the RCD;

in response to determining that the pipe joint is entering the RCD, increasing a weight-on-bit (WOB) setpoint so as to increase a measured WOB;

after increasing the WOB setpoint, determining that the pipe joint is exiting the RCD; and in response to determining that the pipe joint is exiting the RCD, decreasing the WOB setpoint so as to decrease the measured WOB.

10. The system of claim 9, wherein the RCD comprises one or more seals for sealing against the pipe joint, and wherein determining that the pipe joint is entering the RCD comprises determining that a front of the pipe joint has contacted the one or more seals of the RCD.

11. The system of claim 9, wherein determining that the pipe joint is entering the RCD comprises determining that a measured block height corresponds to a first block height setpoint.

12. The system of claim 11, wherein determining that the pipe joint is exiting the RCD comprises determining that the measured block height corresponds to a second block height setpoint that is not equal to the first block height setpoint.

13. The system of claim 12, wherein the method further comprises, before determining that the measured block height corresponds to the second block height setpoint, determining the second block height setpoint based on the first block height setpoint and a length of the pipe joint.

14. The system of claim 9, wherein the method further comprises, before determining that the pipe joint is entering the RCD, preventing adjusting of a rate of penetration (ROP) setpoint for at least a portion of a duration that the pipe joint is in the RCD.

15. The system of claim 14, further comprising, after determining that the pipe joint is exiting the RCD, allowing adjusting of the ROP setpoint.

16. The system of claim 9, wherein increasing the WOB setpoint comprises progressively increasing the WOB setpoint.

17. A non-transitory computer-readable medium having stored thereon computer program code configured when executed by one or more processors to cause the one or more processors to perform a method comprising:

determining that a pipe joint is entering a rotating control device (RCD);

in response to determining that the pipe joint is entering the RCD, increasing a weight-on-bit (WOB) setpoint so as to increase a measured WOB;

after increasing the WOB setpoint, determining that the pipe joint is exiting the RCD; and in response to determining that the pipe joint is exiting the RCD, decreasing the WOB setpoint so as to decrease the measured WOB.

18. The non-transitory computer-readable medium of claim 17, wherein the RCD comprises one or more seals for sealing against the pipe joint, and wherein determining that the pipe joint is entering the RCD comprises determining that a front of the pipe joint has contacted the one or more seals of the RCD.

19. The non-transitory computer-readable medium of claim 17, wherein determining that the pipe joint is entering the RCD comprises determining that a measured block height corresponds to a first block height setpoint.

20. The non-transitory computer-readable medium of claim 19, wherein determining that the pipe joint is exiting the RCD comprises determining that the measured block height corresponds to a second block height setpoint that is not equal to the first block height setpoint.

21. The non-transitory computer-readable medium of claim 20, further comprising determining the second block height setpoint based on the first block height setpoint and a length of the pipe joint.

22. The non-transitory computer-readable medium of claim 17, further comprising, before determining that the pipe joint is entering the RCD, preventing adjusting of a rate of penetration (ROP) setpoint for at least a portion of a duration that the pipe joint is in the RCD.

23. The non-transitory computer-readable medium of claim 22, further comprising, after determining that the pipe joint is exiting the RCD, allowing adjusting of the ROP setpoint.

24. The non-transitory computer-readable medium of claim 17, wherein increasing the WOB setpoint comprises progressively increasing the WOB setpoint.

25. A system for controlling a drilling operation, comprising:

a drill string comprising multiple sections of pipe, wherein each pair of successive sections of pipe defines a respective pipe joint;

a rotating control device (RCD) comprising one or more seals forming a seal around the drill string; and one or more RCD mitigators comprising one or more processors configured to perform a method comprising, during axial movement of the drill string through the RCD:

preventing adjusting of a rate of penetration (ROP) setpoint;

after preventing adjusting of the ROP setpoint, progressively increasing a weight-on-bit (WOB) setpoint, so as to increase a measured WOB, from a first point in time wherein a front of one of the pipe joints has not yet entered the RCD to a second point in time wherein a rear of the pipe joint has entered the RCD;

after progressively increasing the WOB setpoint, progressively decreasing the WOB setpoint, so as to decrease the measured WOB, from a third point in time wherein the front of the pipe joint has not yet exited the RCD to a fourth point in time wherein the rear of the pipe joint has exited the RCD; and after progressively decreasing the WOB setpoint, allowing adjusting of the rate of penetration (ROP) setpoint.

* * * * *